United States Patent [19]

Berwald et al.

[11] 4,088,238

[45] May 9, 1978

[54] FRAME CONTAINER FOR PRESSURE VESSELS

[75] Inventors: Ernst Berwald, Bergkamen-Heil; Volker Asbeck, Unna, both of Germany

[73] Assignee: Schering Aktiengesellschaft, Berlin and Bergkamen, Germany

[21] Appl. No.: 704,835

[22] Filed: Jul. 13, 1976

[30] Foreign Application Priority Data

| | | |
|---|---|---|
| Jul. 16, 1975 | Germany | 2531681 |
| Jan. 28, 1976 | Germany | 2603073 |

[51] Int. Cl.[2] ..... B65D 87/00; B66C 1/00; B62D 23/00

[52] U.S. Cl. ..... 220/1.5; 220/84; 294/67 DA; 296/35 A; 105/366 B

[58] Field of Search ..... 220/1.5, 23.2, 23.4, 220/23.83, 84; 24/221 R, 221 K; 294/67 R, 67 DA, 67 DB, 81 R; 214/10.5 R, 38 CA; 296/35 A; 105/366 B, 366 C

[56] References Cited

U.S. PATENT DOCUMENTS

| | | | |
|---|---|---|---|
| 2,963,310 | 12/1960 | Abolins | 294/67 DA |
| 3,584,824 | 6/1971 | Belcer | 105/366 B |
| 3,749,438 | 7/1973 | Loomis et al. | 294/67 R X |
| 3,872,555 | 3/1975 | Link et al. | 220/1.5 X |
| 3,912,103 | 10/1975 | Gerhard | 220/1.5 |
| 3,980,185 | 9/1976 | Cain | 220/1.5 X |
| 3,989,294 | 11/1976 | Carr | 296/35 A |

*Primary Examiner*—William Price
*Assistant Examiner*—Steven M. Pollard
*Attorney, Agent, or Firm*—Curtis, Morris & Safford

[57] ABSTRACT

A frame container for pressure vessels is disclosed which includes coupling elements for releasably mounting the pressure vessels in the frame container. Coupling elements are also provided at the corners of the frame to allow a plurality of frames to be secured together.

3 Claims, 25 Drawing Figures

FIG. 2a
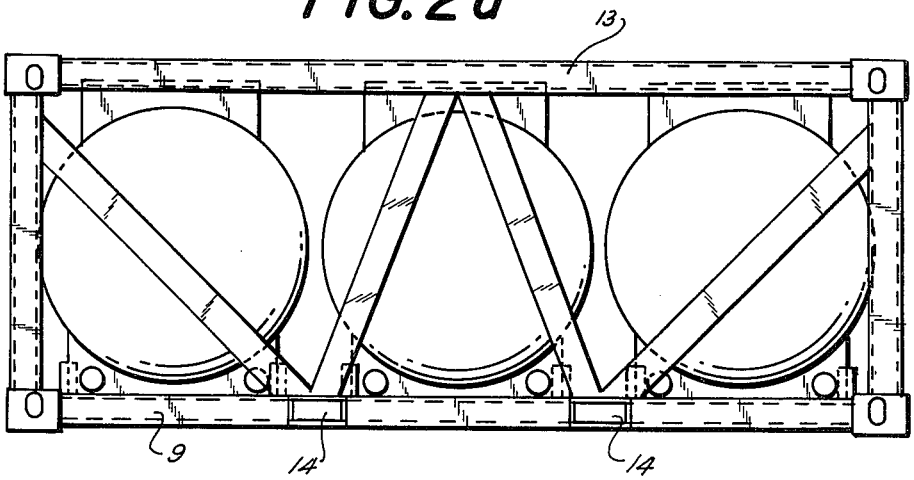
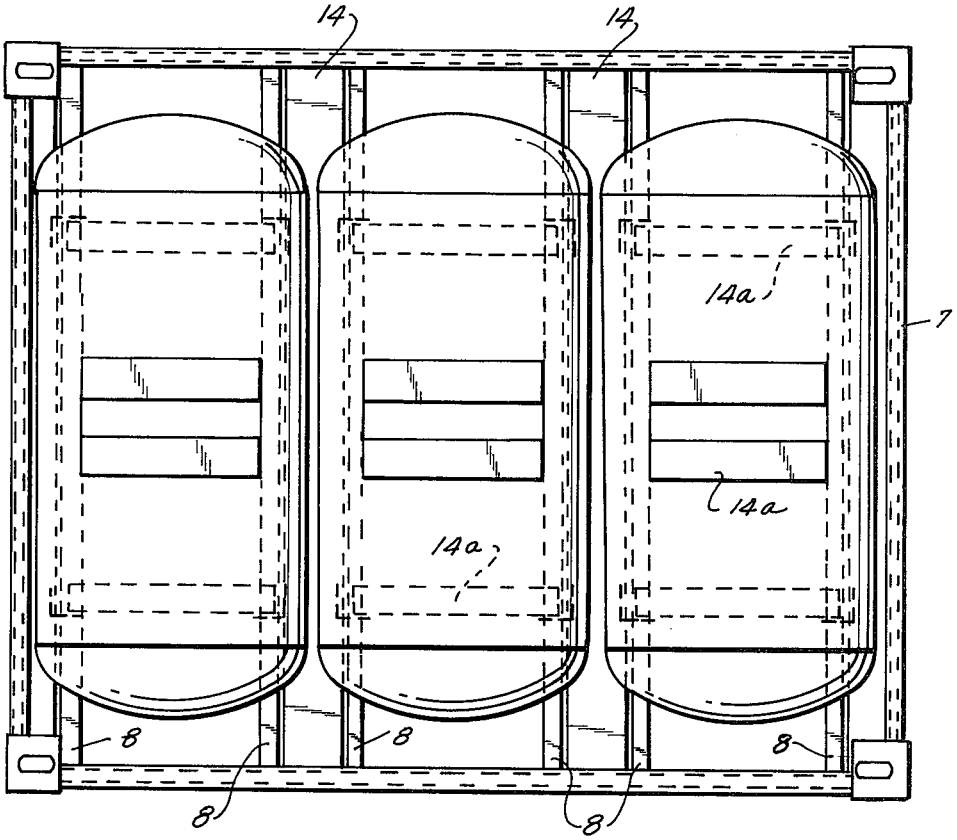
FIG. 2

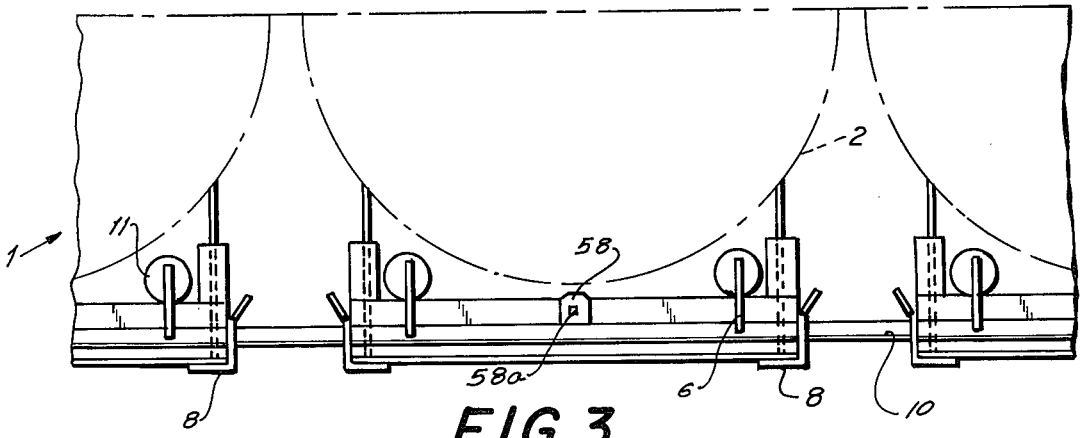
FIG. 3
FIG. 4a
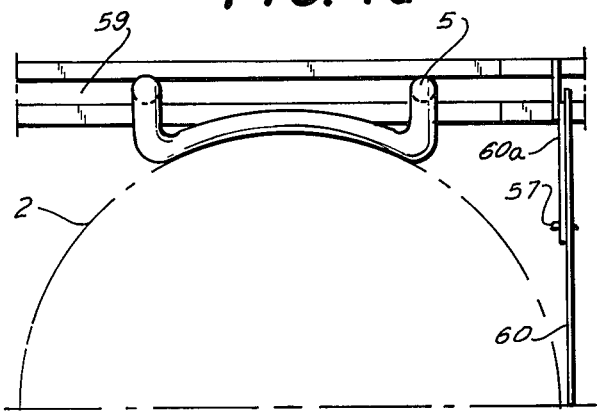
FIG. 3a
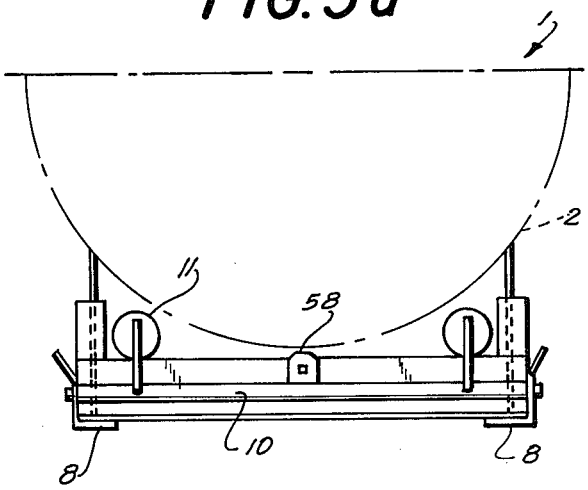
FIG. 4
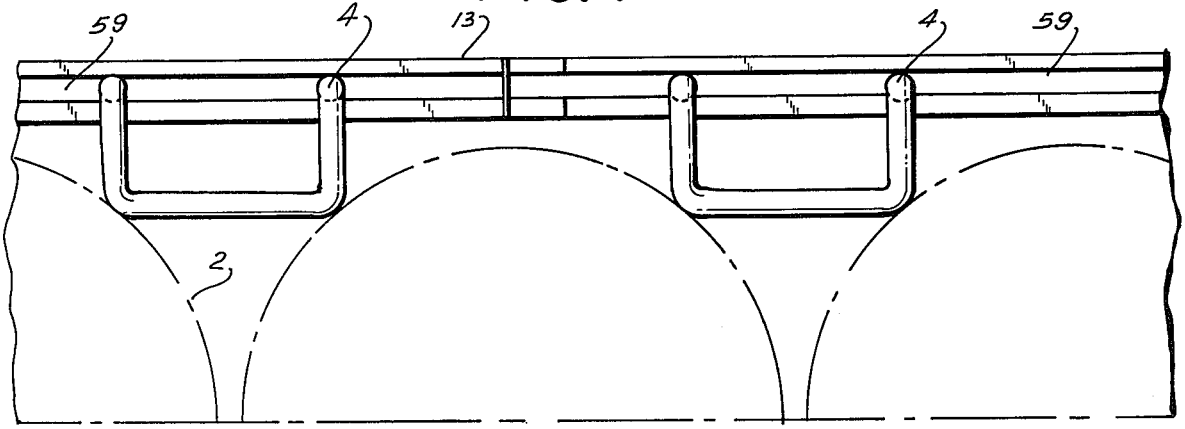

FIG. 5
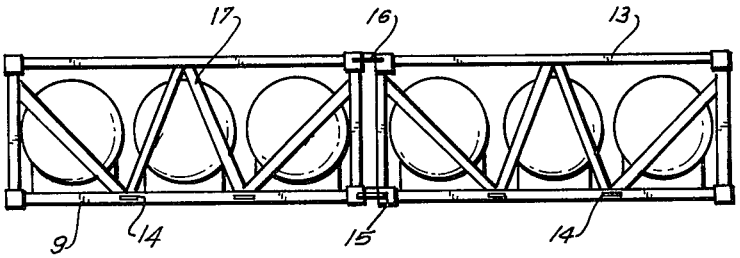
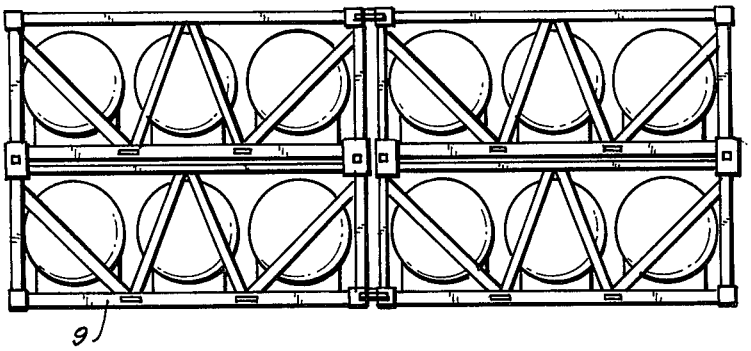
FIG. 5a
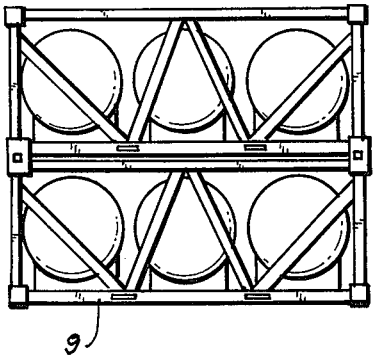
FIG. 5b

FIG. 7a
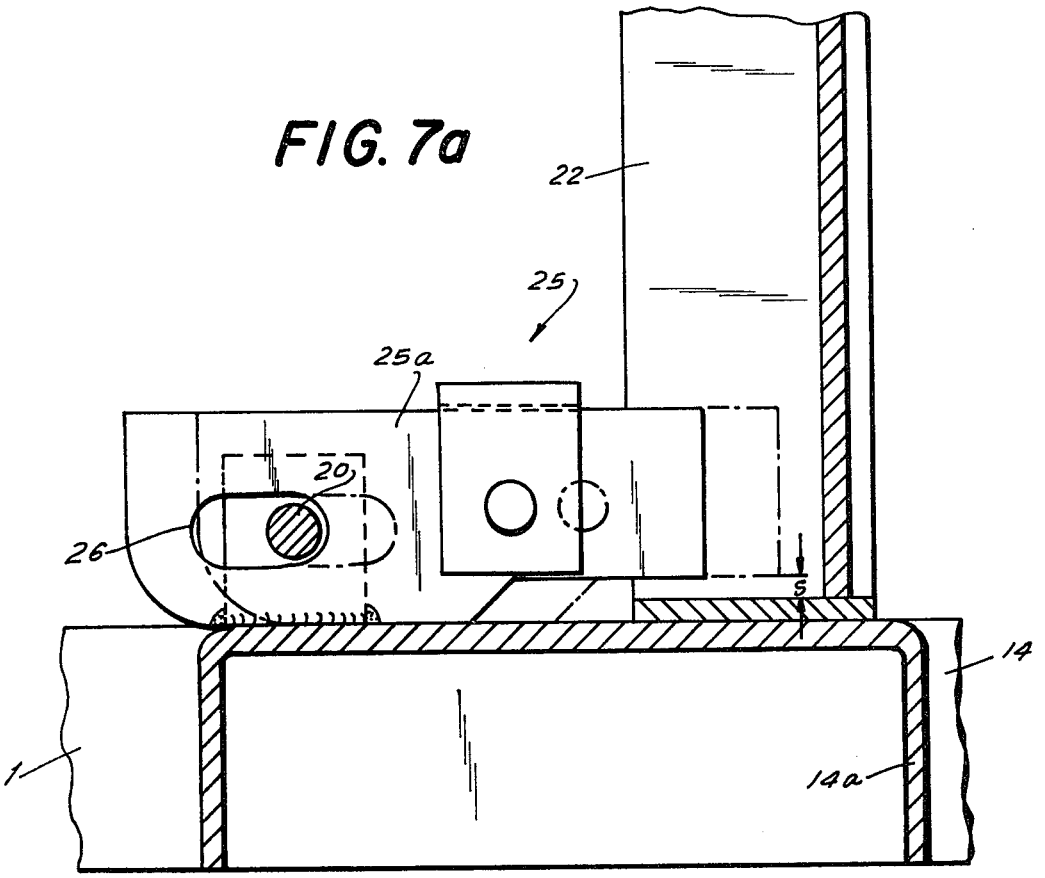
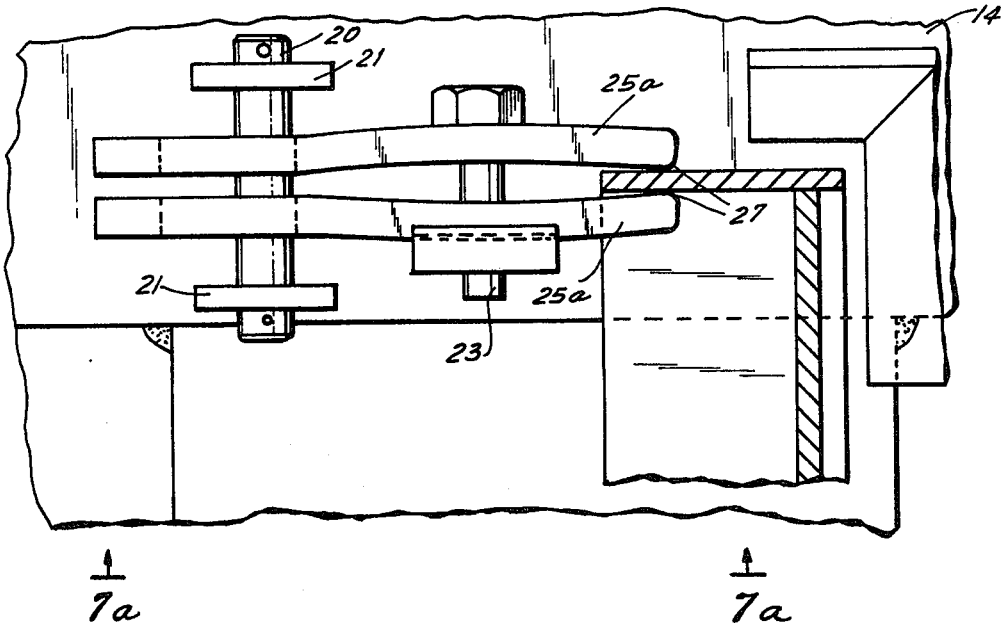
FIG.7

FIG.8b
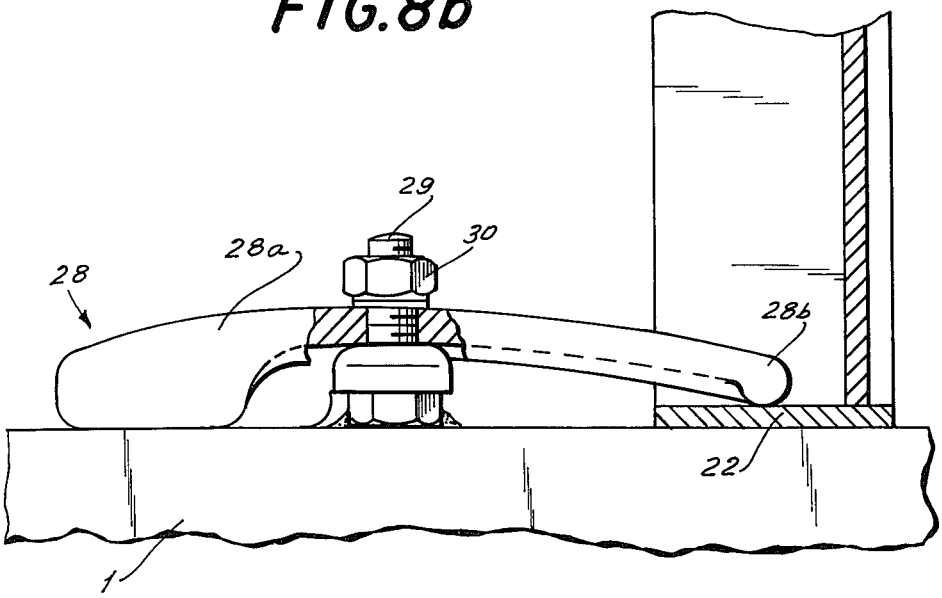
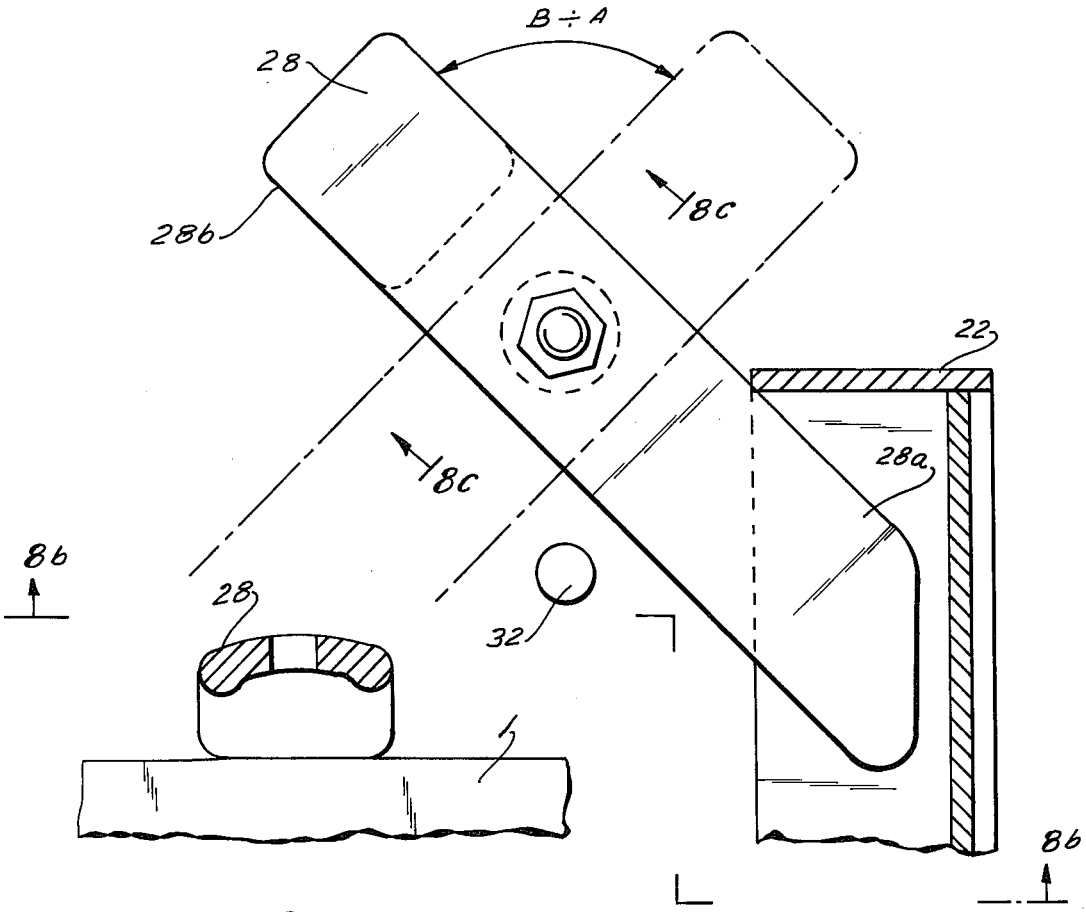
FIG.8c
FIG.8a

FIG. 9
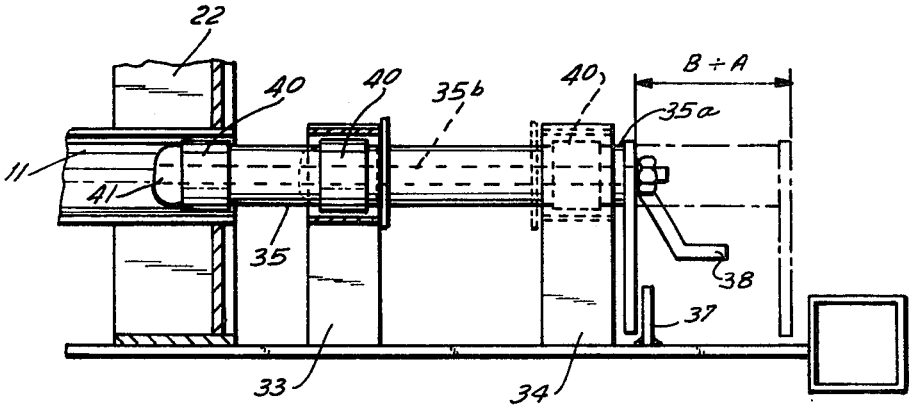
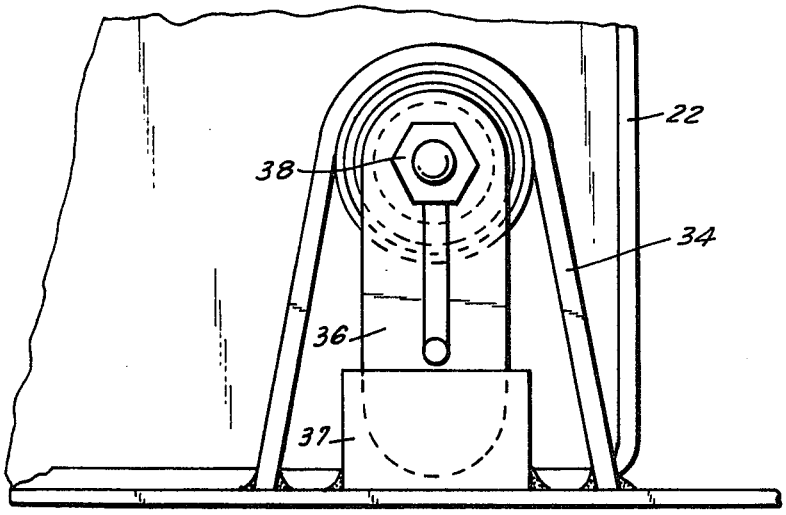
FIG. 9a

FRAME CONTAINER FOR PRESSURE VESSELS

The present invention relates to frame containers which can be coupled and stacked, and in particular relates to containers used to hold and support pressure vessels for dangerous fluids, especially for spontaneously combustible materials.

Pressure vessels suitable for mounting in frame containers of the invention can take a variety of forms, such as are described, for example, in the DOS No. 2,363,471. In FIG. 2 of the DOS No. 2,363,471 there is shown a pressure vessel or container having an access dome recessed into the pressure vessel. In this way, the space or cubic volume required for the vessel is reduced as compared to that required by containers whose access dome extends outward of the vessel. But, at the same time, the arrangement of fittings in the recessed dome is a disadvantage. FIG. 3 of the DOS No. 2,363,471, on the other hand, illustrates a pressure vessel container wherein the fittings are arranged in a semi-cylindrical cup that is positioned perpendicular to the container axis. In this way, provision is made for optimal servicing of the fittings, while allowing for removal of water from the cup. Furthermore, the small height of the structure results in a considerable reduction of the space or cubic volume occupied by the pressure vessel.

These pressure vessels are used to store and transport dangerous fluids. However, for transport by road, rail, and ship, they have the disadvantage that they do not correspond to the dimensions of the "International Organization for Standardization" (ISO). In addition, the safety requirements which have been and are established with respect to the transportion of dangerous fluids are constantly increasing. And, in view of these safety requirements, particularly expensive measures are required to make these pressure vessels safe so as to satisfy them.

Dangerous fluids transported in such vessels can involve pure materials, solutions, suspensions, liquefied gases, etc. Materials of this type which react violently either with oxygen or with moisture in the air are particularly dangerous. These include, for example, organic metal compounds, metal halogenides, etc.

While frame containers for holding pressure vessels have previously been proposed in the art, these frame containers have the disadvantage that no dangerous fluids of the type described above can be transported in them. Further, such previously proposed vessels are rigidly connected to the frame and cannot be removed therefrom or replaced.

The invention has as one of its objects the provision of a frame container for pressure vessels which overcomes the disadvantages of such previously proposed frame containers. Another object is to produce a frame container in which pressure vessels can be replaceably inserted. These pressure vessels can be of the type now being used to transport dangerous fluids.

The above, and other objects, features and advantages of this invention will be apparent in the following detailed description of an illustrative embodiment thereof which is to be read in connection with the accompanying drawing wherein:

FIG. 2 is a plan view of the container shown in FIG. 1;

FIG. 2A is an end view of the container of FIGS. 1 and 2;

FIG. 3 is an enlarged partial end view taken along line 3—3 of FIG. 1;

FIG. 3A is an end view similar to FIG. 3 of the mounting for a single pressure vessel;

FIG. 4 is a partial sectional view taken along line 4—4 of FIG. 1 showing a top clamp for the pressure vessel;

FIG. 4A is a partial sectional view taken along line 4A—4A of FIG. 1;

FIGS. 5, 5A and 5B illustrate various stacking arrangements for the frame containers of the present invention;

FIG. 7 is a view similar to FIG. 6 of another clamping device;

FIG. 7A is an end view taken along line 7A—7A of FIG. 7;

FIG. 8A is a top view similar to FIG. 6 of the clamping device shown in FIG. 8;

FIG. 8B is a view taken along line 8B—8B of FIG. 8A;

FIG. 8C is a sectional view taken along line 8C—8C of FIG. 8A;

FIG. 9 is a side view of yet another clamping device;

Figure 1:
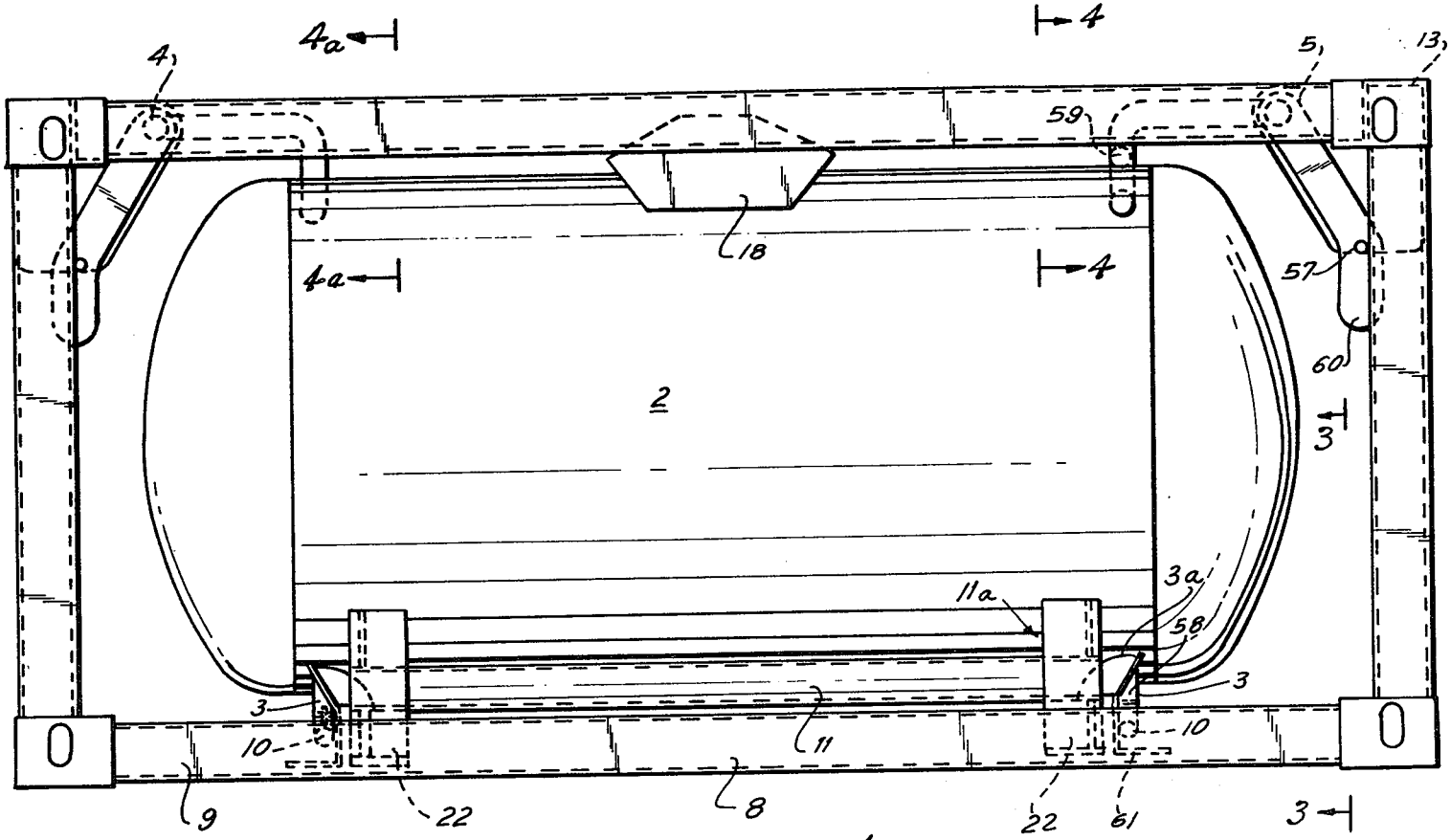
FIG. 1 is a side elevational view of a frame container constructed in accordance with one embodiment of the present invention.

Referring now to the drawing in detail, and initially to FIG. 1 thereof, a frame container 1 is illustrated which is adapted to removably receive an elongated pressure vessel 2 of the type used to transport dangerous liquids. The frame container is constructed to be coupled and stacked with other containers and includes a number of clamping devices 3, 4, and 5 which serve to removably secure the pressure vessel in the frame.

Frame container 1 consists essentially of a four-sided open structure formed of tubular or channel iron construction with dimensions according to ISO standards, e.g. 10 × 8 × 4 feet. To facilitate movement of the frame container stacking pockets or channels 14 are secured in the base of the frame (see FIGS. 1 and 2). The channels extend transversely of the frame between the bottom guides or frame elements at the outer sides of the frame and have open ends through which the tines of a fork lift truck can be inserted. The channels are supported against the upper girder 13 at the upper end of the frame by an "A" frame brace arrangement formed by bars 17 or the like. In addition cross frame elements 14A can be provided to reinforce channels 14. A plurality of frames 1 can be coupled and stacked together to form one unit (see FIGS. 5, 5A and 5B).

This coupling and stacking is achieved by means of coupling elements and pressure elements 15, 16 (more fully described hereinafter) which are situated at the lower and/or upper girder respectively of the container frame.

In accordance with one embodiment of the invention the container frame has lower clamping elements or fastening equipment 3 secured to angle irons 8 which are positioned to extend transversely of the container in spaced location to each other between the lower girders 9 at the sides of the container, and to which the angle irons 8 are secured. In the embodiment of the invention illustrated in FIGS. 1–3 the clamping equipment 3 includes a shaft 10 rotatably mounted in any convenient manner on the angle iron 8. Claws 3A, having a generally L-shaped configuration, are rigidly attached to shaft 10 for rotation therewith. These claws are located to enter the open ends of the pipes 11 which form part of the vessel seat or support 11A. The shaft 10 and claws 3 are held in a fixed position by a set screw 58 threadably engaged in a horizontal plate 58A on angle iron 8. To release vessel 2, the set screw is loosened and the claws are pivoted away from the ends of pipe 11.

As seen in FIG. 3 the shaft 10 is one elongated shaft associated with each of the vessels 2 in frame 1. Alternatively, as seen in FIG. 3A, the frame 1 can be constructed to accommodate only a single vessel 2 with the shaft 10 then extending only across the single vessel in the frame.

To aid in holding vessel 2 in frame 1 an additional clamping device 5 is provided along one end of frame 1. This clamping device includes a rock shaft 59 pivotally mounted on one end of the upper transverse girders 13 of the container above the vessels (see FIG. 4). This clamping device 5 includes yoke elements 59A associated with each of the vessels 2 and engages the top surface thereof. An operating lever 60 is rigidly secured to shaft 59 to permit pivoting of the shaft to disengage yoke 59A from the vessels when it is desired to remove the vessels from the container. The shaft 59, and thus yokes 59A, can be locked in the clamping position shown in FIG. 4 by means of a pin 57 inserted in aligned openings in the lever 60 and a plate 60A fixed on guide 13. Another upper clamping device 4 which can be used in lieu of or in conjunction with the clamping device 4 is shown in FIG. 4A. This clamping device consists of U-shaped bars 4A rigidly mounted on a shaft 59 rotatably mounted on one of the end girders 13 of the frame. These bars 4A are located to be between vessels 2, as seen in FIG. 4A, when shaft 59 is rotated to the clamping position. The shaft can be locked in the clamping position by a lever and pin arrangement 60, 57 as described above with respect to the embodiment of FIG. 4.

Although the clamping devices 3, 4 and 5 are illustrated in the drawings as being fixed in a locked clamping position, as described above, it is contemplated that the clamping devices can be designed to be resilient, in order to dissipate forces applied to the vessels during movement. For example, mechanical devices such as friction brakes or springs as well as hydraulic and pneumatic devices can be connected to the clamping devices to permit slight movements therein used to dissipate the forces.

Figure 8:
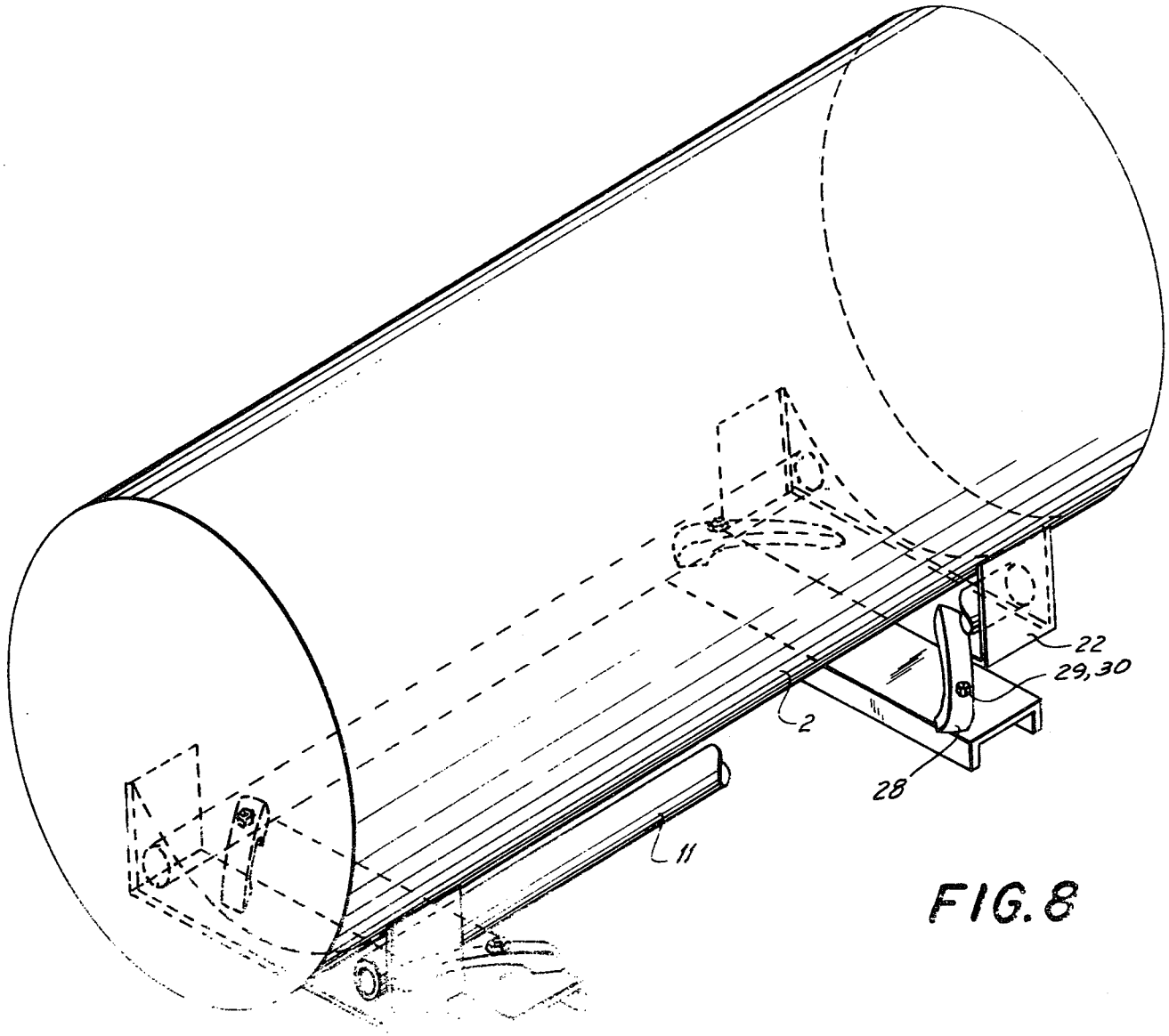
FIG. 8 is a schematic perspective view of yet another clamping device showing its cooperation with the base or foot of the pressure vessel.

For reasons of efficient production, and of simple and reliable handling, mechanical clamping devices, e.g. of the type shown in FIG. 8, are preferred. Such clamping devices, used to dissipate the forces caused by movement of the container, can, depending on requirements, be secured on two to four ends of the vessel seat 11A.

Frame containers which are equipped with force dissipating clamping elements according to the invention can be exposed to considerable dynamic stresses during braking and acceleration movements which occur with transport by road, rail, or ship. These processes entail no impairment or damage of these clamping devices.

As seen in FIG. 1, and more clearly in FIG. 8, the vessel seat or support 11A includes the longitudinally extending pipes 11 and U-shaped feet 22 secured to the vessel at their free ends. These feet are utilized, as described hereinafter to cooperate with the various clamping devices to hold the vessel 2 in frame 1.

Figure 6A:
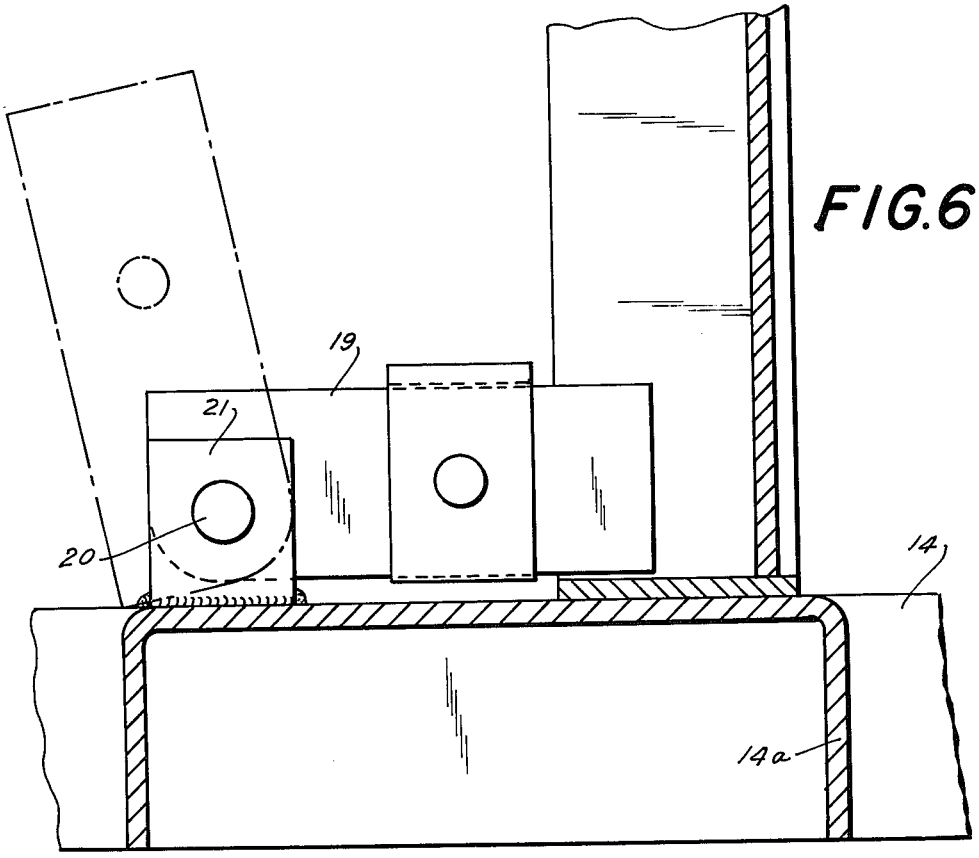
FIG. 6A is an end view taken along line 6A—6A of FIG. 6.
Figure 6:
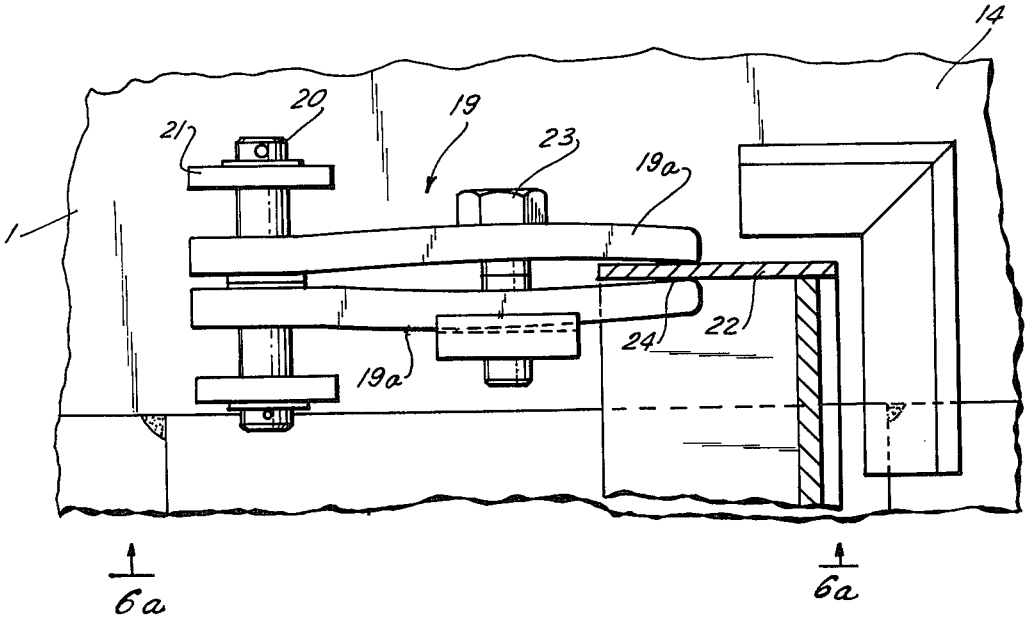
FIG. 6 is a top plan view of one embodiment of a clamping device for securing the base supports or feet of the pressure vessel to the frame.

Referring to FIG. 6, a clamping device 19 is illustrated which is pivotally mounted on a bolt or pivot 20. The bolt 20 is fastened to container frame 1 by means of two rings 21 secured to a bottom element of frame 1, e.g. channels 14 or cross frame elements 14A. The clamping device consists of two slightly curved plates 19A. If the vessel is set into the container frame, the clamping plates 19A are displaced so that the vertical edge of one leg 22 of the vessel is located between them. By tightening the clamping screw and nut assembly 23, the clamping plates are pressed against the edge of the U-shaped leg with a definite force or torque. If stresses exceeding this force occur, the vessel seat can be displaced slightly upwards to absorb this force. The resulting friction at the point 24 where plate 19A engages leg 22 acts to dissipate the force.

FIGS. 7 and 7A illustrate another clamping device which includes two curved clamping plates 25 pivotally mounted on bolt 20. The bolt is fastened to container frame 1 by means of two rings 21 as in the prior embodiment. Along their lengthwise direction, these clamping plates have an elongated hole 26 formed therein. If the vessel is set into the container frame, the clamping plates are displaced so that the edge of the vertical leg of member 22 is situated between the plates as shown in solid lines in FIG. 7A. The clamp plates are then moved into position, shown in phantom lines, and they are pressed against the edge of seat 22 by tightening the screw and nut assembly 23. When stresses exceed this force, the vessel seat can be displaced upwards along the path and horizontally through the distance s shown in the drawing. The resulting friction at the point 27 where the plates engage seat 22 also acts to dissipate the forces.

The embodiment of the clamping device shown in FIGS. 8—8C comprises clamping plate 28 which is curved and has generally right angular end portions 28A, 28B. Plate 28 is pivotally mounted on a threaded bolt 29 secured to frame 1 and held on the bolt by a nut 30. When the vessel 2 is placed in frame container 1, the clamping plate 28 is pivoted from its dotted line position A to its solid line position B (see FIG. 8A) over a stop bolt 32 secured in frame 1 adjacent bolt 29. In this position B, the longer lever arm 28B of plate 28 lies on the foot or base of the vessel seat 22. The clamping plate 28 is then pressed with a definite force against the foot of the vessel seat by tightening the nut 30. Depending on the dimension of the distancing plate or washer 31 placed on nut 29, the desired tension of the clamping plate can be adjusted. In its tightened position the plate 28 is blocked from movement out of engagement with the base of seat 22 by stop 32 under the influence of lateral forces applied to the vessel. The bolt 32 is dimensioned to engage the plate in its tightened position but is short enough to allow the plate to be lifted over it when nut 30 is loosened.

The clamping device shown in FIGS. 9 and 9A includes a bolt 35 which is slidably and rotatably mounted in the bearings 33 and 34 secured to a bottom frame element of frame 1. The bolt is located to be aligned with the pipe 11 of the vessel seat 22 in order to enter the pipe and fasten the vessel to the container. This engagement occurs when the bolt is shifted from its phantom line position A in FIG. 9 to its solid line position B. As a stop, the lever 36 secured to bolt 35 is positioned between a stopping plate 37 and the bearing 34.

The bolt 35 includes a first rigid collar 35A secured to lever 36, and a pair of collars 35B and 35C freely slidable thereon, as well as three compression rings formed of rubber or other resilient material. In addition, bolt 35 includes a threaded rod 39 extending from a rigid head secured thereto through elements 35A, 35B, 35C, 40 and 36 to a nut 38. By tightening the nut 38 on threaded rod 39, the compression rings 40 are squeezed between rigid elements 41, 40 and thus expand to engage the interior surfaces of pipe 11 and the bearings 33, 34. Thus the bolt positively connects the vessel to frame 11. Under stress, the elasticity of the compression buffers affords a reversible, force-dissipating displacement of the vessel.

Figure 10:
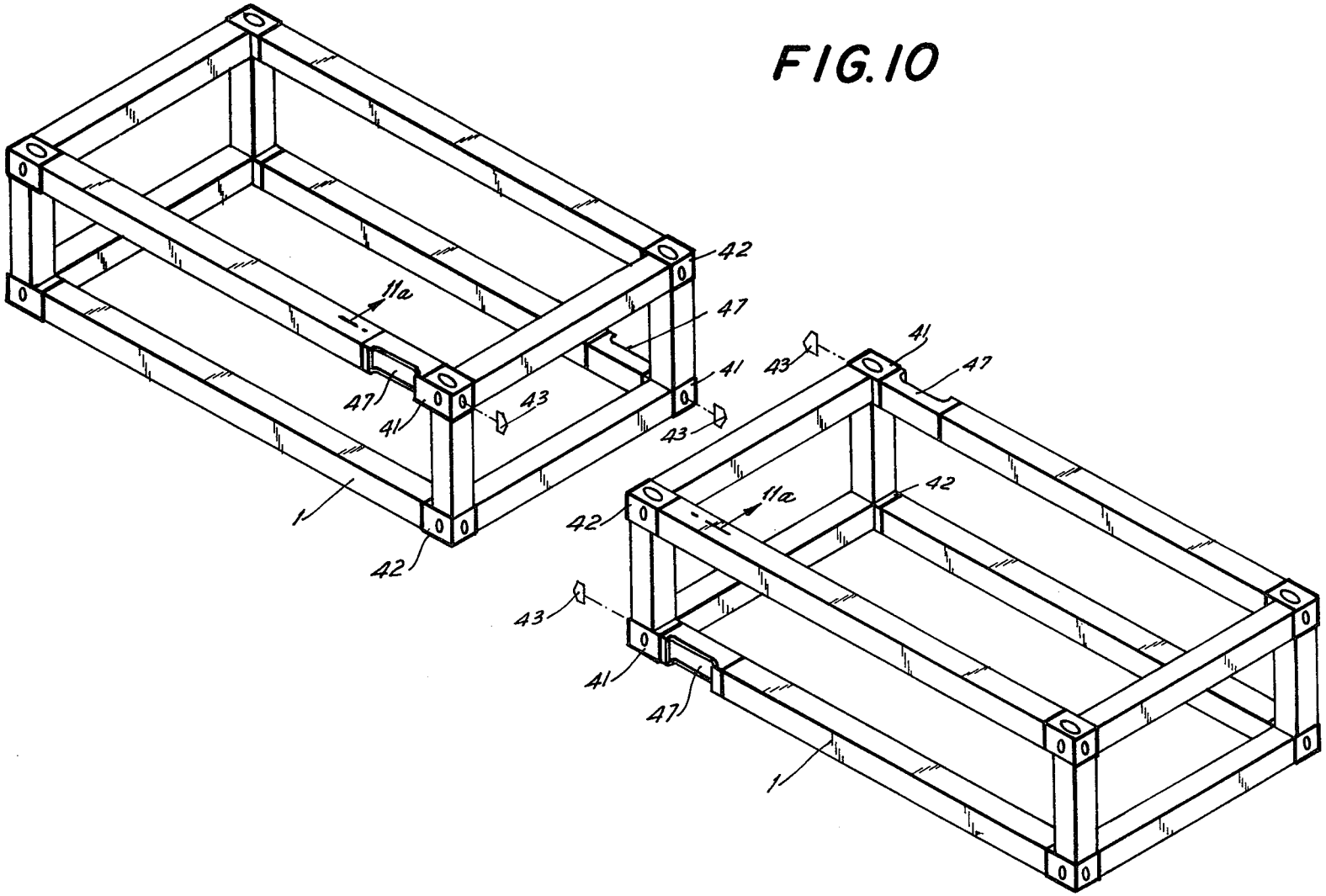
FIG. 10 is a perspective view of two frame containers using frame connectors according to one embodiment of the present invention.
Figure 11:
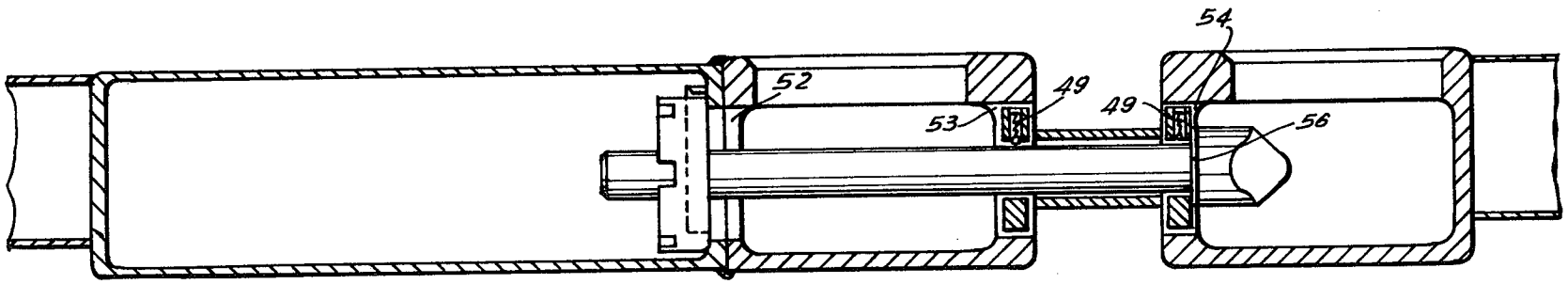
FIG. 11 is a view similar to FIG. 10A but showing the frame ends connected.

In accordance with another feature of the present invention the frame containers 1 are provided with coupling elements 15, 16 which are permanently mounted therein to allow the frames to be readily coupled and decoupled. In the illustrated embodiment, as shown in FIGS. 10 and 11 the frame containers 1 are formed with ISO corner mounting Nos. 3 and 4 (according to DIN 15190). These mountings serve to accommodate coupling elements 15, 16 to couple the container frames with other containers.

Non-positive coupling was previously used with ISO containers, and such coupling is permitted by the German Lloyd under Journal No. 36886/73. Compared to such non-positive couplings, the couplings according to the present invention have the advantage that the coupling elements cannot be detached from the frame without using tools, even when the container is in its decoupled state, and consequently they cannot be lost after the container has been decoupled.

Figures 10A, 10B:
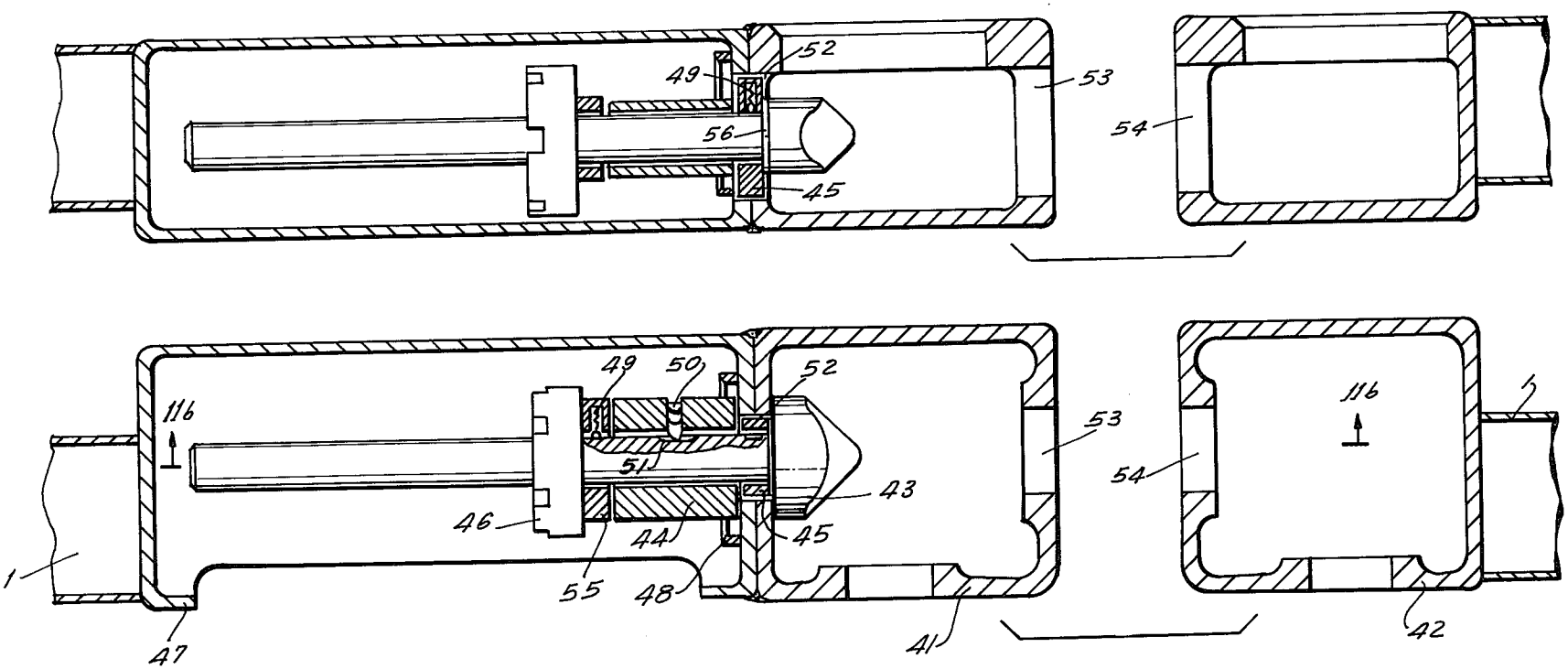
FIG. 10A is a top sectional view taken along line 10A—10A of FIG. 10.
FIG. 10B is a side sectional view taken along line 10B—10B of FIG. 10.
Figure 11A:
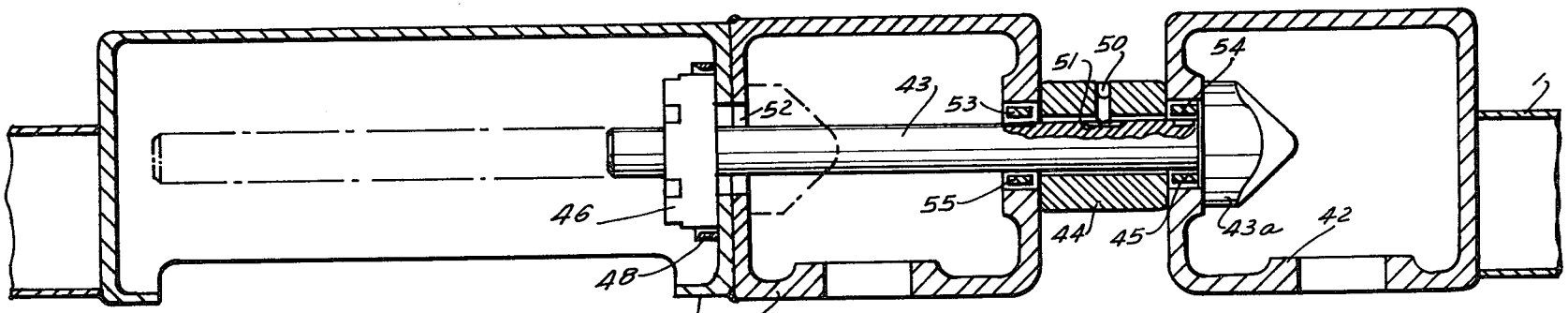
FIG. 11A is a sectional view taken along line 11A—11A of FIG. 11.

As seen in FIGS. 10A, 10B, and 11A, a bolt 43 having a generally oval shaped hammer head 43A is used as the coupling element. The threaded shaft of the bolt is situated in a housing 47 which is affixed to one of the girders 13 of container frame 1. The oval hammer head, on the other hand, is situated in the ISO corner mounting No. 3, identified as element 41 in the drawing.

A first oval guide ring 45, an oval spacer element 44, a second oval guide ring 55 are all rotatably mounted on shaft 43 and a tensioning nut 46 is threadably mounted thereon. Shaft 43 is only threaded to such a distance that the tensioning nut 46 can be solidly screwed down against guide ring 55. While the guide rings are rotatable with respect to shaft 43 they are normally secured against rotational motion about the shaft by means of spring biased ball detents 49 engaged in keyways formed in the shaft. Spacing ring 44 is arranged for free sliding movement along a small distance over the length of the shaft. This distance is defined by a lengthwise groove or keyway 51 which is milled into the shaft, and a setscrew 50 is mounted in spacing ring 44 to selectively lock the ring in a selected position by engagement in groove 51.

As seen in FIGS. 10A and 10B, in the retracted position of shaft 43, the first guide ring 45 is situated in an oval bore or opening 52 formed in the reinforced rear wall of the ISO corner mounting No. 3, i.e. element 41.

Finally, shaft 43 includes an integral four-sided boss 56 behind hammer head 43A which also is engaged in oval bore 52 in the reinforced rear wall of the ISO corner mounting No. 3 (41). In this manner the boss holds the shaft against uncontrolled rotation.

In this position, shaft 43 is also securely locked against sliding out of its mounting since (as seen in FIGS. 10A and 10B) the major axes of the oval hammer head 43A, of the oval cross section of the spacer ring 44, and of the cross section of the second guide ring 55, are at a right angle to the major axes of the oval bores 52, 53 in the ISO corner mounting No. 3 (41).

In order to couple the corners of the containers (as seen in FIGS. 11A and 11B), the hammer head 43A is extended as described hereinafter from ISO corner 3 into the adjacent corner of an adjacent frame, which corner is preferably an ISO corner No. 4. For this coupling, the hammer head shaft 43 with its spacer ring 44 and its second guide ring 55 is turned 90° about its longitudinal axis. The shaft is then pushed forward so far that its hammer head 43A extends into the ISO corner mounting No. 4 (element 42 in the drawing). These steps occur after tensioning nut 46 has been screwed back an appropriate distance.

Thereafter the hammer head shaft 43 is again rotated by 90° about its longitudinal axis and it is pulled back until the four-sided boss 56 engages the oval bore 54 of ISO corner mounting No. 4 (42). In this way, boss 56 stops the hammer head shaft 43 from turning about its longitudinal axis. Tensioning nut 46 is then tightened with the aid of an L-key inserted through the opening 47A of element 47. The tensioning nut 46 is centered in the housing 47 when tightened by the open guide ring 48 secured to the inner face of the housing.

As shown in FIGS. 11 and 11A, in the coupled position, the first guide ring 45 is located in the bore 53 of ISO corner mounting No. 3 (41), and the second guide ring 55 is located in the bore 54 of ISO corner mounting No. 4 (42). The spacing ring 44 takes care of the necessary distance between the ISO corner mountings and the container frames, which are thus non-positively coupled together.

Although in the illustrative embodiment of the invention the coupling element is shown mounted in ISO corner mounting brackets No. 3, it is contemplated that they can be mounted in ISO corner brackets No. 4 instead.

By arranging the corner brackets as illustrated in FIG. 10, the ISO corner brackets facing away from the coupling side of the frame correspond to the corner brackets or fittings of DIN 15190 so that the assembled frame unit has eight exterior corner brackets corresponding to the ISO corner brackets specified in DIN 15190.

Although illustrative embodiments of the invention have been described herein with reference to the accompanying drawings, it is to be understood that various changes and modifications may be effected therein without departing from the scope or spirit of this invention.

What is claimed is:

1. A frame container for pressure vessels comprising a polygonal frame defining an interior space for receiving a pressure vessel therein; said frame having a plurality of corners and including standard ISO corner mountings on at least some of said corners; and means mounted in said frame adjacent at least some of the ISO corner mountings for securing its associated corner mounting to an ISO corner mounting on another container; said corner mountings having oval openings therein and said means including an elongated bolt slidably mounted in said frame and its associated corner mounting for longitudinal movement therein between frame coupled and frame decoupled positions; said bolt including an oval shaped head having a flat rear surface being normally located within its associated corner mounting in the frame decoupled position of the bolt, a pair of spaced oval guide rings mounted thereon, and an oval spacer ring mounted thereon between said guide rings; a nut mounted on said bolt adjacent the guide ring removed from the head to hold the rings in closely assembled relation to the head; said oval head and rings being arranged in the decoupled position of the bolt such that the major axis of said oval head and the major axis of the spacer ring are transverse to the major axis of the oval opening in their associated ISO corner mounting through which the bolt extends, and the major axis of the oval guide ring adjacent the head is parallel to the major axis of said oval opening and is located in that opening, whereby the head and spacer ring serve to hold the bolt against longitudinal movement.

2. A frame container as defined in claim 1 wherein at least said guide ring adjacent the oval head of the bolt is rotatable on the bolt, whereby the bolt may be rotated therein to align the major axis of said guide rings, spacer ring, and head so that the bolt and head can be extended from their decoupled position out of their associated ISO corner mounting through the oval opening in an ISO corner mounting of another frame and can then be rotated to their original position to hold the head locked in said ISO corner mounting of said another frame.

3. A frame container as defined in claim 1 wherein said flat rear surface of the oval head has a square boss formed thereon which is located to enter adjacent oval openings of said ISO corner mountings in the coupled and decoupled positions thereof to prevent rotation of the bolt.

* * * * *